United States Patent [19]

Green et al.

[11] Patent Number: 4,934,950

[45] Date of Patent: Jun. 19, 1990

[54] KEYED ELECTRICAL CONNECTORS WITH JACKSCREWS

[75] Inventors: Eric T. Green, Hummelstown; John S. Margosiak, Middletown; Dennis E. Smith, Elizabethtown, all of Pa.

[73] Assignee: AMP Incorporated, Harrisburg, Pa.

[21] Appl. No.: 400,857

[22] Filed: Aug. 30, 1989

[51] Int. Cl.[5] ..... H01R 13/645; H01R 13/621

[52] U.S. Cl. ..... 439/681; 439/362

[58] Field of Search ..... 439/292, 345, 359, 677, 439/680, 681, 362, 367, 607

[56] References Cited

U.S. PATENT DOCUMENTS

| | | | |
|---|---|---|---|
| 2,746,022 | 5/1956 | Gilbert | 339/92 |
| 2,902,665 | 9/1959 | D'Amico | 339/184 |
| 3,030,602 | 4/1962 | Jackson et al. | 339/92 |
| 3,112,974 | 12/1963 | Curtis et al. | 339/49 |
| 3,177,461 | 4/1965 | Hagan et al. | 339/184 |
| 3,426,315 | 2/1969 | De Tar | 339/105 |
| 3,491,330 | 1/1970 | Barnhart et al. | 339/184 |
| 3,555,491 | 1/1971 | Moss | 339/92 |
| 3,573,677 | 4/1971 | Detar | 333/79 |
| 3,582,867 | 6/1971 | Thompson et al. | 339/92 |
| 3,594,698 | 7/1971 | Anhalt | 339/75 M |
| 3,771,108 | 11/1973 | Haftner et al. | 439/681 |
| 3,853,381 | 12/1974 | Morningstar | 339/92 M |
| 4,109,987 | 8/1978 | Bourdon | 339/75 M |
| 4,159,862 | 7/1979 | Funck et al. | 339/186 M |
| 4,181,391 | 1/1980 | Kilsdonk | 339/92 M |
| 4,277,126 | 7/1981 | Lincoln | 339/186 M |
| 4,460,230 | 7/1984 | McKee et al. | 339/106 |
| 4,519,667 | 5/1985 | Canning et al. | 339/186 M |
| 4,715,829 | 12/1987 | Preputnick | 439/660 |
| 4,778,411 | 10/1988 | Rudy, Jr. et al. | 439/681 |

FOREIGN PATENT DOCUMENTS

| | | |
|---|---|---|
| 961714 | 6/1964 | United Kingdom . |
| 1089073 | 11/1967 | United Kingdom . |

OTHER PUBLICATIONS

AMP Catalog 81-655 Revised 3-86; "AMP-HDI 2--Piece Pc Board Connectors," pp. 39-40, AMP Incorporated, Harrisburg, PA.

AMP Catalog 79-547 (Revised 8-88); "Subminiature D Pin and Socket Connectors per MIL-C-24308(Amplimite)"; pp. 37-38, AMP Incorporated, Harrisburg, PA.

*Primary Examiner*—Eugene F. Desmond
*Assistant Examiner*—Walter G. Hanchuk
*Attorney, Agent, or Firm*—Anton P. Ness

[57] ABSTRACT

Keying and fastening of mating connectors includes pairs of mating key members, ones of which include central apertures through which extend respective jackscrews having threaded leading ends, and the others of which have threaded apertures into which the jackscrews are threaded to fasten the connectors together after the pairs of keys permit connector mating. The keys in which the jackscrews are mounted permit rotating the jackscrews. The jackscrew leading ends are recessed slightly behind the leading ends of hood-like keying projections of the key members for protection against damage and misalignment, and the threaded apertures of the other keys extend to the leading ends of the keying projections thereof which are adapted to receive the corresponding hood-like keying projections in axial recesses along the outer surfaces extending about halfway around the circumference of the key. The connectors including the jackscrews preferably include shells having recesses or apertures within which the keys and jackscrews are mounted, so that structure of the shells extends forwardly to the key and jackscrew leading ends and extend around most of the circumference of the key members and the jackscrews, thus protecting them during connector handling.

9 Claims, 2 Drawing Sheets

10
12
14
16
18
20
22
24
26
30
32
34
36
37
38
40
42
44
46
48
50
100
110
112
114
116
118
120
126
130
132
134
136
137
138
140
142
144
150
160
162
164
166
168
170
172
174
176

KEYED ELECTRICAL CONNECTORS WITH JACKSCREWS

FIELD OF THE INVENTION

The present invention relates to the field of electrical connectors and more particularly to matable connectors which are matchingly keyed.

BACKGROUND OF THE INVENTION

Certain electrical connectors are to be mated to mating connectors with mating arrays of terminals thereof to become electrically engaged along connector mating faces. Where a plurality of similar such connectors are located adjacent each other in an array, for mating to a like plurality of mating connectors, the connectors must be labeled or otherwise visibly marked to indicate which of the mating connectors all similar in appearance and shape, are to mate with which of the mounted connectors all similar in appearance and shape.

It would be desirable to provide a means to mechanically prevent all but the particular mating connector from being mated to a particular connector. Types of connectors are known in which cooperating keying structures are utilized which are shaped and positioned and correspondingly oriented along the respective mating faces of the pair of connectors to allow mating when the two connectors matchingly keyed are being moved axially together, but abut and physically obstruct mating when two connectors are being moved together which are not matchingly keyed.

Such keys are usually used in pairs matable with corresponding pairs and usually have body sections which are hexagonal or (octagonal) in cross-sectional shape, and the keys of each pair are secured to a respective one of the connectors with their body sections in apertures of the connector housing which are correspondingly shaped in cross-section; thus each key can be secured in its respective aperture in any one of six (or eight) different positions, respectively. Each key includes a keying projection extending axially forwardly from the body section but only extending around about one half of the circumference; the corresponding key will have a keying projection which will enter the region comprising about the remainder of the circumference, when the two connectors which are matchingly keyed are moved axially together. The opposing keys of two otherwise matable connectors which are not matchingly keyed, will abut at their leading ends prior to at least the mating terminals of the connectors engaging. By coordinating the selection of positions of the two keys within the respective apertures of each connector of the pair desired to be matable, the keys provide a means for physically encoding the mating faces of the pair of connectors. Exemplary keys are disclosed in U.S. Pat. Nos. 4,277,126; 3,426,315; 4,159,862; 3,491,330; and 4,778,411.

Certain connectors are also known in which a pair of jackscrews are utilized to hold the connectors together in mated relationship by extending from one connector to a threaded aperture of the other along the mating face, where each jackscrew is rotatable to bring the connector mating faces assuredly together in the last stages of mating. For example, see U.S. Pat. Nos. 3,853,381; 3,573,677 and 3,112,974.

There are prior art connectors in which jackscrew hardware is assembled to the connector in conjunction with keying hardware radially surrounding portions of the jackscrews to economize on space across the mating faces on the connectors, as in U.S. Pat. Nos. 4,181,391; 3,555,491; 4,109,987 and 3,582,867.

In U.S. Pat. No. 3,555,491 polarizing members are disposed in apertures of lateral flanges of molded plastic housings and have three circumferentially spaced polarizing projections extending forwardly of the leading ends of the connector housings. A jackscrew extends through a central passageway of each member of one of the connectors and has a threaded forward shank end extending forwardly of the polarizing projections. The opposing member includes a threaded insert axially rearwardly of the projections to be threadedly engaged by the threaded jackscrew end during fastening after connector keying. Threaded engagement between the jackscrew and the insert occurs after the polarizing projections of the polarizing members have moved past each other along most of their lengths. The reference also discloses a mechanism for preventing overtorque during turning of the jackscrew, by allowing rotation of the threaded insert after a certain torque level has been reached as the connectors are completely mated. Other prior art discloses using jackscrews with polarizing hardware or assembled to serve a polarizing function include U.S. Pat. Nos. 2,902,665 and 2,746,022.

In U.S. Pat. No. 4,181,391 a connector mounted to a printed circuit board includes a key member which includes a threaded aperture rearward of the keying projection and is adapted to be threadedly engaged by a correspondingly threaded forward shank end of the jackscrew extending from a corresponding key of the mating, matchingly keyed connector. If the mating connectors were not matchingly keyed, the opposing keying projection forward ends would abut, the connectors would not mate, and the forward jackscrew end would not enter the threaded key aperture to fasten the connectors together.

It is desired to provide keying for a mating pair of connectors where the keying is adapted to be utilized with jackscrew fastener mechanisms, where it is desired that such connectors be assuredly held together by hardware, in a manner which minimizes the amount of mating face real estate occupied by the total of the keying and fastener hardware.

It is also desired to provide a means for assembling the keys and jackscrews easily and in a manner permitting easy disassembly, for facilitating assembly and disassembly at the application site in order for customizing the key orientations and permitting changing the orientations, as well as replacement of parts.

It is further desired to provide jackscrew/keying systems which are defined in a minimum number of separate parts by providing a connector shell modified to facilitate assembly.

It is yet further desired to provide jackscrew/keying systems in which the jackscrew/keying hardware and especially the jackscrew forward end are protected from damage and misalignment.

SUMMARY OF THE INVENTION

The present invention provides for securing the keys to the connectors away from the contact region of the mating faces thereof, by securing the keys to the lateral flanges defined by the shell members of the connectors. For a pair of hexagonal keys, for example, to provide for thirty-six different keying arrangements, the mounting aperture of each flange of each shell member includes a forward region having a correspondingly hexagonal shape formed into the metal, and a rearward region of the mounting aperture remains conventionally circular with a smaller diameter. Each of the key members includes a body section having the hexagonal cross-sectional shape to be seated in the correspondingly shaped aperture region which will prevent rotation of the key member after mounting. Forwardly from each body section extends the appropriate keying projection, and rearwardly therefrom extends the mounting section through the circular small diameter mounting aperture region. In a machined metal shell member the hexagonal forward aperture region may be a recess extending transversely into the side surface of a flange end and have opposed side walls and an inward wall defined by flat surfaces and having three portions corresponding to three adjacent sides of a hexagon which is centered about the circular small diameter mounting aperture region.

One of the key members (termed herein a mounting key) is adapted to receive a jackscrew member mounted therealong, while the other key member (a mating key) is adapted to be threadedly engaged by a forward threaded end of the shank of the jackscrew member upon connector mating, where the connectors are matchingly keyed. The jackscrew member includes a forward shank portion which is threaded, and the keying projection of the mounting key defines a generally semicircular hood which is radially spaced from and coextending forwardly along the jackscrew shank to a leading end forward of the jackscrew forward end; the hood is defined by an inner cylindrical surface coaxial with the jackscrew shank, and an outer surface defined by three adjacent flat surfaces comprising three sides of a hexagon.

The mounting key of the present invention includes a profiled aperture having a larger diameter forward portion within which a larger diameter body section of the jackscrew is seated, and a smaller diameter rearward portion through which extends a smaller diameter jackscrew mounting section, with both of the aperture portions dimensioned to allow the jackscrew to be rotated freely within the mounting key after assembly. The jackscrew includes a rearward shank portion extending rearwardly, and a slotted jackscrew nut is placed thereon, and a roll pin is inserted transversely through aligned small holes to secure the nut on the jackscrew and the jackscrew to the connector in a manner permitting rotation relative to the connector and the mounting key seated therein, with the roll pin being removable to permit disassembly if desired. The connector shell extends to a leading end just forwardly of the hood-shaped keying projection leading end, with the mounting key and the jackscrew shank and their leading ends disposed within the forward aperture portion which extends to the shell leading end; the shell thus provides protection against damage or misalignment during handling for the mounting key and jackscrew shank by extending radially therearound except along the flange end surface.

The mating key includes a keying projection which is generally a sleeve having a central bore thereinto which is threaded to be engaged by the forward jackscrew end upon connector mating. In cross-section the keying projection extends radially outwardly to three flat side surfaces defining half of a hexagon extending around half of the periphery of the sleeve, while the remainder of the sleeve periphery is defined by a cylindrical surface of an appropriate small diameter thereby defining an axial recess and being adapted to receive therealong the hood-shaped keying projection of the mounting key upon connector mating when the connectors are matchingly keyed, as the jackscrew shank is threadedly received into the central bore upon rotation of the jackscrew. The mating key includes a rearward shank portion extending rearwardly from the connector and includes an annular slot for a C-shaped locking ring to be snapped thereon to secure the mating key to the connector, in a manner permitting disassembly.

It is an objective of providing keying for connectors fastenable together with jackscrews, without increasing the lateral dimensions of the shell flanges commonly in use with the prior art connectors, thus not increasing the envelope occupied by the connector assembly, facilitating close connector spacing.

It is also an objective to provide jackscrew/keying systems in which the jackscrew begins threading into the mating fastening hardware as early in the mating procedure as possible which stabilizes the connectors as early in the fastening procedure as possible, while being slightly recessed from the key's leading end to provide a measure of physical protection from damage and misalignment during handling.

It is a further objective to provide jackscrew/keying systems for connector assemblies having shell members together laterally protecting the mating dielectric housing portions, where the jackscrews begin to be threadedly engageable with mating fastening hardware immediately after key members meet to permit connector mating.

It is an additional objective to provide a connector system wherein the jackscrew/keying system substantially is physically protected from possible damage during handling.

It is yet a further objective to provide a means for securing the hardware to the connectors easily, permitting on-site key orientation in the context of an array of like connectors, and in a manner permitting easy disassembly if desired for replacement of parts or re-orientation of a key.

An embodiment of the present invention will now be described with reference to the accompanying drawings.

DETAILED DESCRIPTION OF THE PREFERRED EMBODIMENT

Figures 1, 2:
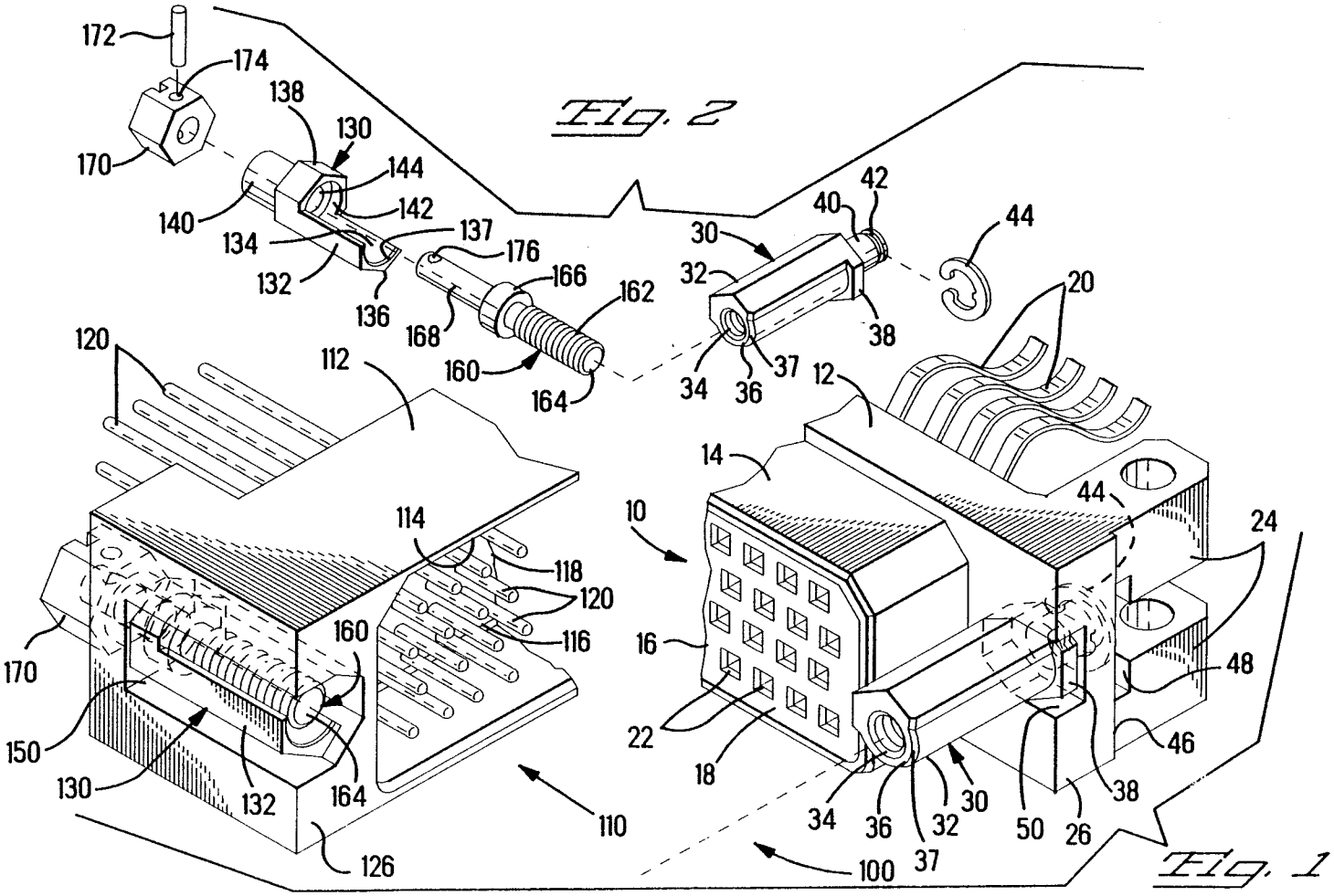
FIG. 1 shows corresponding end portions of shells of a matable pair of connectors which are matchingly keyed, showing the jackscrew and keying hardware of the present invention.
FIG. 2 illustrates the jackscrew and keying hardware of the present invention.

Connector assembly 100 comprises a pair of matable electrical connectors 10,110 as shown in FIG. 1 and are matchingly keyed using the keying and jackscrew hardware according to the present invention. Connectors 10,110 have shell members 12,112 with shell 12 having a forward hood section 14 which is receivable into large cavity 114 of shell 112 upon keying, mating and fastening of the connectors; forward hood section 14 and large cavity 114 are correspondingly dimensioned and D-shaped for polarization so that mating of the connectors occurs when both connectors are at least appropriately oriented with respect to each other, as is known.

In connector 10, forward hood section 14 of shell 12 is adapted to surround a forward plug section 16 of dielectric housing 18 in which socket terminals 20 are secured with their socket contact sections recessed within respective passageways 22. Connector 10 is adapted to be mounted to an edge of a printed circuit card (not shown) by pairs of rearward card-receiving flanges 24 defining card-receiving slots, and terminals 20 include cantilever beam contact sections extending rearwardly to be soldered to respective conductive traces on the card. In connector 110 large cavity 114 of shell 112 is situated forwardly of the mating face 116 of dielectric housing 118, with pin contact sections of terminals 120 mounted in the housing extending forwardly of the mating face to matingly engage socket contact sections of terminals 20 of the mating connector 10. Terminals 120 are shown having post sections extending rearwardly for mounting in respective plated through-holes of a printed circuit board (not shown). Such a connector assembly 100 is generally known in Part Nos. 534776 and 534777 sold by AMP Incorporated, Harrisburg, Pennsylvania, and from U.S. Pat. No. 4,715,829.

The keying and jackscrew hardware utilized in the present invention is similar to that disclosed in U.S. patent application Ser. No. 07/400,640 filed Aug. 30, 1989 and assigned to the assignee hereof. Referring to FIGS. 1 and 2, shell 12 includes a flange 26 at each end laterally of the hood section 14. Flange 26 includes an aperture 28 extending therethrough providing for securing a key member 30 to shell 12. Key member 30 includes a keying projection 32 having a threaded bore 34 thereinto from leading end 36, a hexagonal body section 38, and a rearward mounting section 40 having an annular recess 42 thereinto to receive a C-shaped locking ring 44 thereinto when assembled to flange 26. Mounting section 40 extends through aperture 28 so that annular recess 42 is exposed just rearwardly of rearward flange surface 46. A slot 48 is formed in the shell where rearward flanges 24 extend from flange 26, so that C-shaped locking ring 44 is insertable thereinto to snap around key mounting section 40 within annular recess 42 and is accessible to be removed if desired for disassembly. Flange 26 also includes a recess 50 forwardly of aperture 28 shaped to define a seat for key body section 38 and include at least four sides of the hexagon closely corresponding to four sides of the hexagonally shaped body section 38, in order to hold key 30 against rotation after assembly. The key members and corresponding seating apertures could also have the shape of an octagon or other regular polygon.

Keying projection 32 includes around about half of its periphery a series of three adjacent flat side surfaces defining three sides of a hexagon, which may extend forwardly from three sides of the hexagonally cross-sectioned body section 38. The other half of the periphery comprises a semicylindrical surface having a radius smaller than the general cross-sectional dimension of the body section 38, thus defining an axial recess of arcuate shape extending from leading end 36 to body section 38.

Shell 112 includes a flange 126 at each end laterally of large cavity 116. Flange 126 includes an aperture 128 extending therethrough providing for securing a key member 130 to shell 112. Key member 130 includes a keying projection 132 shaped like an elongate semicylindrical hood having an arcuate inner surface 134 extending forwardly to a leading end 136, the key member further including a fully hexagonal body section 138, and a rearward mounting section 140. Hood-shaped keying projection 132 is adapted to be received along the axial recess of keying projection 32 of mounting key 30 during mating of connectors which are matchingly keyed with the mating and mounting keys secured in cooperating keying orientations. Mounting section 140 extends along but entirely within flange aperture 128; body section 138 is disposed within elongate recess 150 which extends inwardly from an end of shell 112 and forwardly to the forward face 152 of shell 112. Elongate recess 150 is defined by flat side surfaces forming four adjacent sides of a hexagon and closely correspond to four sides of the hexagonal body section 138 to prohibit key rotation after assembly.

Jackscrew 160 is assembled to shell 112 of connector 110 along with key 130. Jackscrew 160 includes a forward shank 162 extending to a leading end 164 and is threaded therealong to correspond with threaded bore 34 of key 30 of mating connector 10. Rearwardly from forward shank 162 is a large diameter seating section 166, and rearwardly therefrom extends a smaller diameter mounting section 168. Body section 138 of key 130 includes a large diameter forward hole portion 142 corresponding to jackscrew seating section 166, and a smaller diameter rearward hole portion 144 corresponding in diameter to jackscrew mounting section 168, so that jackscrew 160 is inserted through key 130 for assembly with jackscrew seating section 166 seated within forward hole portion 142 and mounting section 168 extending rearwardly from key section 140. Jackscrew mounting section 168 may optionally include an annular recess located where section 168 exits from the shell's rearward surface into which a C-shaped locking ring (not shown) is snapped to provide a temporary means for holding jackscrew 160 and perforce mounting key member 130 to shell 12 during assembly, facilitating assembly of the keying and jackscrew hardware.

A jackscrew nut 170 is mounted to the rearwardly extending jackscrew mounting section 168 by means of a roll pin 172 inserted in an interference fit transversely through pin-receiving hole 174 of nut 170 and through pin-receiving hole 176 through jackscrew mounting section 168 aligned with hole 174. Roll pin 172 is easily removed by simple tools if desired for replacement of parts or re-orientation of key member 130. Nut 170 is slotted for example to be rotated by a tool such as a screwdriver when it is desired to rotate jackscrew 160 to fasten connectors 10,110 together after keying for full mating, and nut 170 may also be knurled to enable manual rotation if desired. Jackscrew 160 is dimensioned to be rotatable within forward and rearward hole portions 142,144 of key 130. Shell recess 150 provides physical protection axially along and surrounding most of the periphery of keying projection 132 and jackscrew shank 162 to prevent damage and misalignment thereof during handling.

Figure 4:
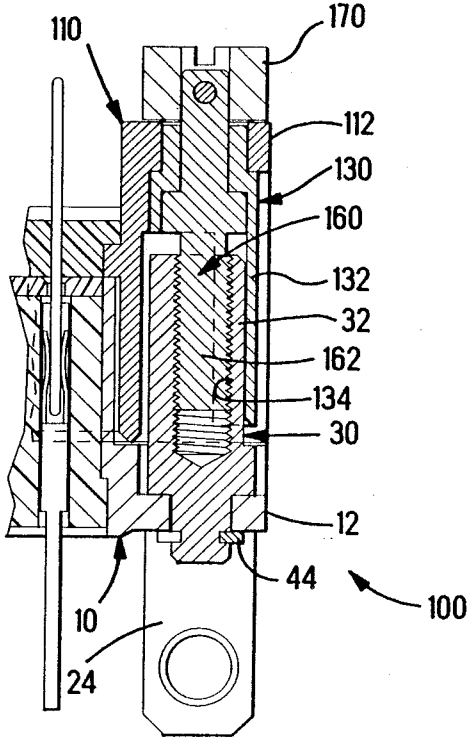
FIGS. 3 and 4 are longitudinal section views of the assembled connector end portions of FIG. 1 aligned to be mated, and mated and fastened respectively.
Figure 3:
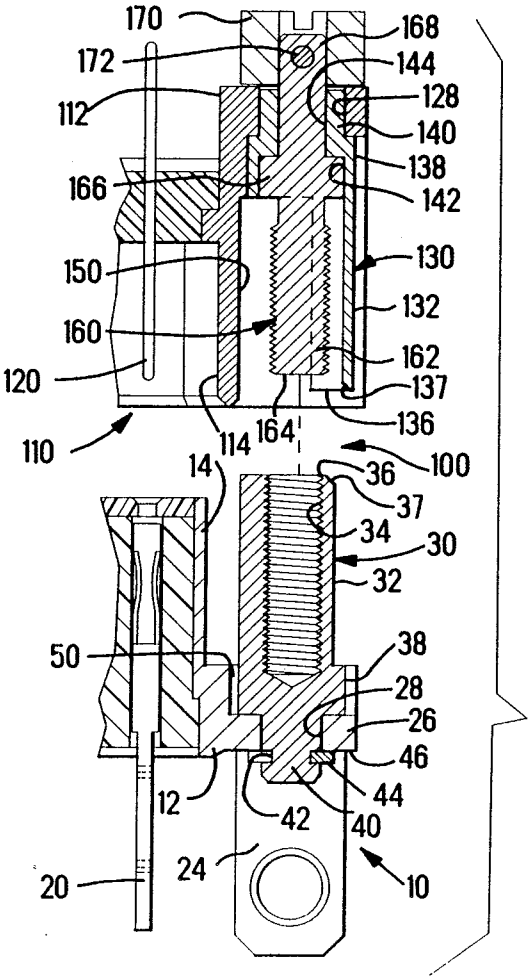

In FIGS. 3 and 4, the keying and mating of connectors 10,110 is illustrated, wherein the advantages of the present invention can be discerned. The jackscrew leading end 164 is recessed behind the leading end 136 of the keying projection 132 of mounting key 130. Leading end 164 of jackscrew 160 thus is shaped and positioned not to extend forwardly of leading end 136 of keying projection 132 or the forward face of shell 112 in a manner which would otherwise render the jackscrew leading end susceptible to being at least laterally stressed upon incidental engagement therewith by foreign objects. Jackscrew 160 thus has a significant measure of protection from damage during connector handling which otherwise could lead to misalignment of the jackscrew and prevent fastening and connector mating. The mounting key member 130 of connector 110 and mating key member 30 of connector 10 are angularly oriented to cooperate with each other to permit mating since connectors 10,100 are desired to be matable and have been matchingly keyed. The outer edge 37 of leading end 36 of keying projection 232 is preferably chamfered, and the inner edge 137 of leading end 136 of keying projection 132 also chamfered, to enable incremental adjustment in the angular orientation of the respective key members 30,130. As soon as the leading ends 36,136 of the keying projections 32,132 of mating and mounting keys pass by each other due to their matching orientation within respective shell recess 50,150, the leading end 164 of jackscrew shank 162 enters threaded bore 34 of mating key 30; rotation of the jackscrews 160 at both ends of connector 110 begins to draw the connectors together until the connectors 10,110 are fully mated together and their terminals are fully electrically engaged. The very early threaded engagement of jackscrew and opposing threaded key aperture allows very early stabilizing of the connectors during fastening, occurring for example while the forward ends of the contact sections of the terminals are spaced apart about ¼ inch or less.

If any of the key members of one connector were not angularly oriented to correspond with the opposed key member of the other connector, the key members would abut before the jackscrews would begin to enter the opposing threaded key bores and thus prevent fastening; and the connectors and their terminal arrays could not mate. Also, if a jackscrew were to be misaligned during handling, full threaded engagement would be adversely affected or even prevented thus preventing full connector mating even if the connectors were matchingly keyed, a condition which the present invention minimizes.

Shells 12,112 shown are formed by being machined of aluminum and anodized, which facilitates forming flat side surfaces of recesses 50,150 in communication with apertures 28,128 and also forming of rearward flanges 24 and ring-receiving slot 48.

In use, connectors 10 are mountable to edge portions of an array of printed circuit cards during assembly of the electronic apparatus, and the angular orientations of each key member 30 of each of the connectors 10 may be selected during apparatus assembly. This assures that each card-mounted connector 10 in an array of up to thirty-six like connectors 10 can be physically coded to be distinct from others of the same array. With each connector 10 being polarized by the D-shaped forward plug section 14 and having two key members 30 of hexagonal shapes, thirty-six coding possibilities exist; if octagonal keys are used, then sixty-four coding possibilities would exist. While each connector 10 may be labeled, the keying system of the present invention provides for mechanical coding to prevent non-matchingly keyed connectors from being mated. With the present invention, a means is provided for securing the keys and jackscrews to the connector shells in a manner permitting the person applying the connectors at the site of in-service use to determine the keying orientations in order to encode the connectors in the context of the connector array being defined at the site. Also, the securing means permits easy disassembly for re-orientation of keys if desired, or replacement of parts if necessary.

The keyed connectors described herein represent the preferred embodiment of the present invention, but it is understood that variations and modifications of the connectors may be made which are within the spirit of the invention and the scope of the claims.

What is claimed is:

1. An improved keying and fastening system for electrical connectors, comprising key members and jackscrew members secured to housing means of first and second connectors matable together, the system being of the type wherein first key members of the first connector have axially oriented aperture means in body sections thereof within which said jackscrews are rotatable and forwardly from which extend threaded forward jackscrew shanks, and second key members of the second connector are adapted to threadedly receive thereinto the threaded forward jackscrew shanks to fasten together the matchingly keyed connectors after keying and mating thereof, the improvement comprising:

said first key members each have a keying projection extending forwardly to a leading end;

said leading ends of said jackscrews being shaped and positioned with respect to said first key member leading ends in a manner minimizing susceptibility of said jackscrew leading ends to being at least laterally stressed upon incidental engagement therewith by foreign objects;

said second key members each have a keying projection cooperable with a said first key member keying projection, each said second key member keying projection extending forwardly to a leading end and having an aperture means extending thereinto from said leading end, said aperture means being threaded to correspond to said threaded forward shank of a respective said jackscrew for said jackscrew to threadedly engage said second key member during fastening upon rotation of said jackscrew, whereby during mating of matchingly keyed connectors, a said jackscrew begins threaded engagement with a respective said second key member almost immediately after said leading ends of said keying projections of said first and second key members begin to pass by each other, and said jackscrew forward end is generally protected by at least said first key member leading end against possible damage and misalignment during handling while not increasing the distance of axial movement necessary to fasten the connectors together after keying during mating.

2. A system as set forth in claim 1 wherein said keying projection of each said first key member is shaped as a hood coextending along and radially spaced from said jackscrew forwardly of said body section around about one half of the circumference of said first key member, and said keying projection of each said second key member includes a recess axially therealong shaped and dimensioned to receive said keying projection of an associated said first key member therealong upon keying.

3. A system as set forth in claim 1 wherein said body sections of said first and second key members are polygonal in cross-section and are mountable in respective seating apertures of said connector housing means having shapes correspondingly polygonal in cross-section.

4. A system as set forth in claim 1 wherein said housing means of said first connector extends to a forward face farther forward than said leading ends of said first key members thereof.

5. A system as set forth in claim 1 wherein said housing means includes aperture means within which said first key members and said jackscrews therethrough are disposed.

6. A system as set forth in claim 5 wherein each said aperture means comprises a recess extending transversely inwardly from a side surface of said first connector housing means.

7. A system as set forth in claim 1 wherein each said jackscrew includes a rearward shank end extending rearwardly from a rear surface of said first housing means, and a slotted nut is placed thereon, with a roll pin inserted in interference fit through aligned transverse holes through said nut and said rearward jackscrew end, securing said jackscrew to said first housing means and said first key member to said first housing means, in a manner permitting rotation of said jackscrew relative to said first housing means and said first key member seated in said aperture means of said first housing means in a selected keying orientation.

8. A system as set forth in claim 1 wherein said second key includes a rearward portion extending rearwardly from a rearwardly facing surface portion of said second housing means and having an annular recess exposed to receive a C-shaped locking ring thereonto, securing said second key member to said second housing means.

9. A system as set forth in claim 1 wherein said leading ends of said jackscrews are located a selected small distance axially rearwardly from said first key member leading ends.

* * * * *

UNITED STATES PATENT OFFICE

CERTIFICATE OF CORRECTION

Patent No. 4,934,950 Dated June 19, 1990

Inventor(s) Eric T. Green, John S. Margosiak, Dennis E. Smith

It is certified that error appears in the above-identified patent and that said Letters Patent is hereby corrected as shown below:

In the Claims:

Claim 8, Column 10, Line 8 - insert the word --each-- after the word "wherein".

Claim 8, Column 10, Line 9 - insert the word --member-- after the word "key".

Signed and Sealed this

Tenth Day of December, 1991

*Attest:*

HARRY F. MANBECK, JR.

*Attesting Officer*

*Commissioner of Patents and Trademarks*